United States Patent [19]

Pritulsky

[11] 4,084,872

[45] Apr. 18, 1978

[54] ELECTRICAL COMMONING MEANS

[75] Inventor: James Pritulsky, Harrisburg, Pa.

[73] Assignee: AMP Incorporated, Harrisburg, Pa.

[21] Appl. No.: 770,160

[22] Filed: Feb. 18, 1977

[51] Int. Cl.[2] ..... H01R 31/08

[52] U.S. Cl. ..... 339/19; 339/217 S

[58] Field of Search ..... 339/19, 47–49, 339/217 S, 222, 252 R, 252 P, 258 R, 258 P

[56] References Cited

U.S. PATENT DOCUMENTS

| | | | |
|---|---|---|---|
| 3,133,780 | 5/1964 | Dean | 339/217 S |
| 3,193,795 | 7/1965 | Krehbiel | 339/217 S |
| 3,942,860 | 3/1976 | McDonough | 339/217 S |
| 3,951,498 | 4/1976 | Michaels | 339/19 |

FOREIGN PATENT DOCUMENTS

| | | | |
|---|---|---|---|
| 1,297,452 | 11/1972 | United Kingdom | 339/217 S |

*Primary Examiner*—Mark S. Bicks
*Attorney, Agent, or Firm*—Frederick W. Raring; William J. Keating; Jay L. Seitchik

[57] ABSTRACT

Electrical commoning means for connecting a plurality of wires to each other at an electrical junction comprises an insulating housing having a terminal-receiving face and having a plurality of side-by-side terminal-receiving cells extending inwardly from the terminal-receiving face. Adjacent cells are separated from each other by a barrier wall having a centrally located opening which permits communication between adjacent cells. The wires which are to be commonly connected have contact terminals on their ends which are dimensioned to be snugly received in the cells. Each terminal has a contact spring extending from one side thereof and a contact surface on the oppositely facing side. The springs are dimensioned such that they will fit in the openings in the barrier walls and in their normal unstressed condition, each spring extends through the adjacent barrier wall and into the next adjacent cell. When two or more terminals are inserted into adjacent cells, the contact springs of the terminals are resiliently flexed by the surface of the adjacent contact terminals thereby to establish electrical contact between adjacent terminals and the wires to which the terminals are crimped are commonly connected. Any number of wires can be connected to a common junction by inserting the terminals on the wires into adjacent cells in the housing.

3 Claims, 3 Drawing Figures

ELECTRICAL COMMONING MEANS

BACKGROUND OF THE INVENTION

This invention relates to electrical commoning means for connecting a plurality of wires to each other at an electrical junction. A wide variety of junction blocks for making common electrical connections are available to the electrical industry for use under widely varying conditions as regards electrical performance, space limitations, and adverse environmental conditions. However, many of these presently available devices are relatively complex and expensive and are not suitable for use under circumstances, such as exist in the appliance industry, where there are no serious space requirements (the junction block need not be extremely small in size) and the environmental conditions are not unduly severe. The cost of the electrical components including junction blocks which are used in the appliance industry and in similiar industries must be extremely low and in this respect, the presently available devices are not entirely suitable.

The present invention is directed at the achievement of an extremely simple and durable electrical commoning means which can be manufactured at a low cost but which is nonetheless entirely satisfactory from an electrical standpoint. Junction means or commoning means in accordance with the invention are well-suited for use under the circumstances as described above where low cost and simplicity are prime requirements and where extreme environmental effects are not encountered.

It is accordingly an object of the invention to provide an improved and simplified electrical commoning means. A further object is to provide a commoning means which comprises a one-piece insulating housing having no metal parts therein which is adapted to receive terminals on the ends of the wires which are to be connected at an electrical junction. A further object is to provide an improved contact terminal for an electrical commoning means. A further object is to provide a commoning means comprising a housing and terminals on the ends of the wires which are to be connected at an electrical junction. A further object is to provide an electrical commoning means for wires which does not require specialized tools to connect or disconnect wires from the electrical junction.

Figure 1:
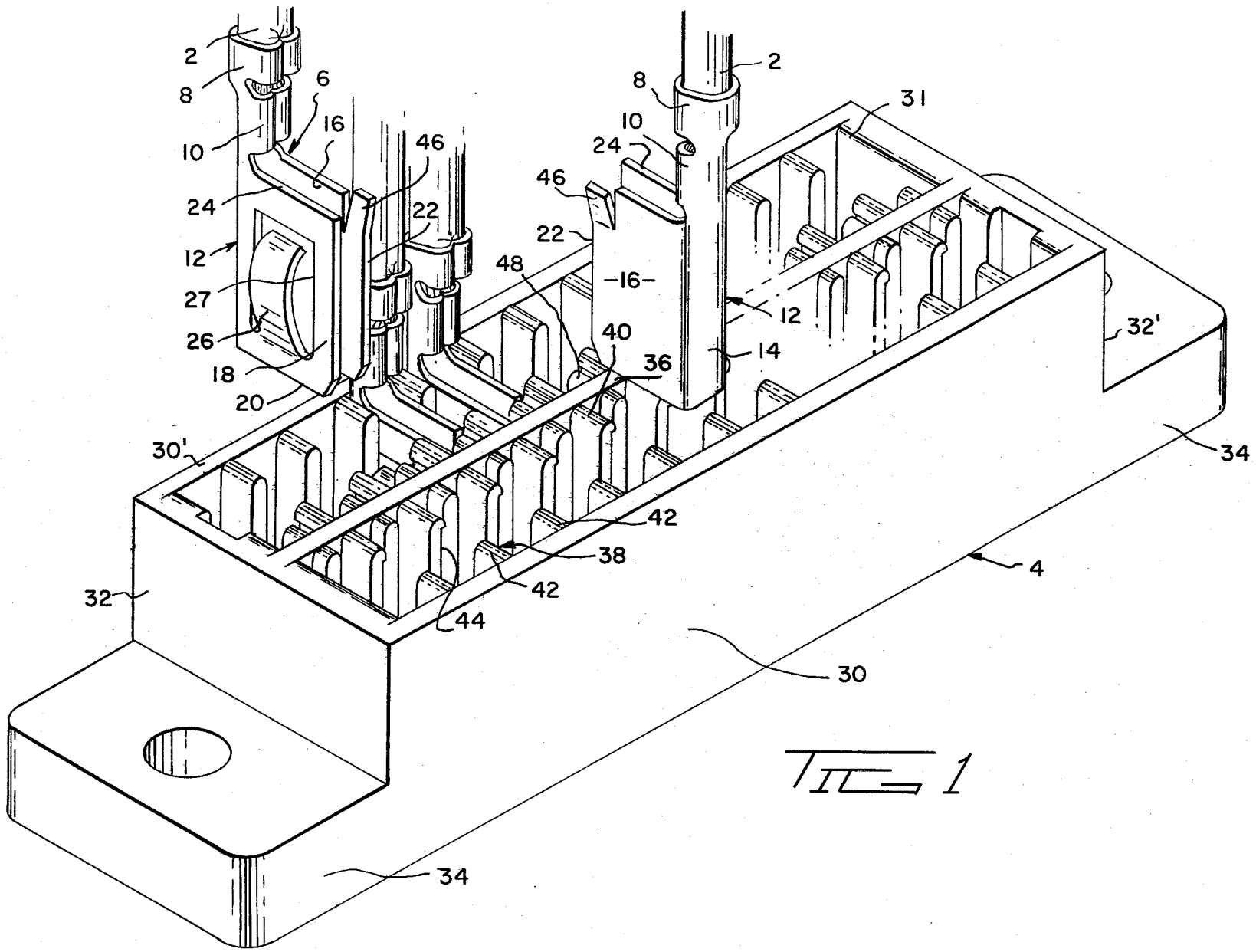

These and other objects of the invention are achieved in preferred embodiments thereof which are briefly described in the foregoing abstract, which are described in detail below, and which are shown in the accompanying drawing in which:

FIG. 1 is a perspective view of a commoning means in accordance with the invention showing two of the terminals exploded from the housing.

Figure 2:
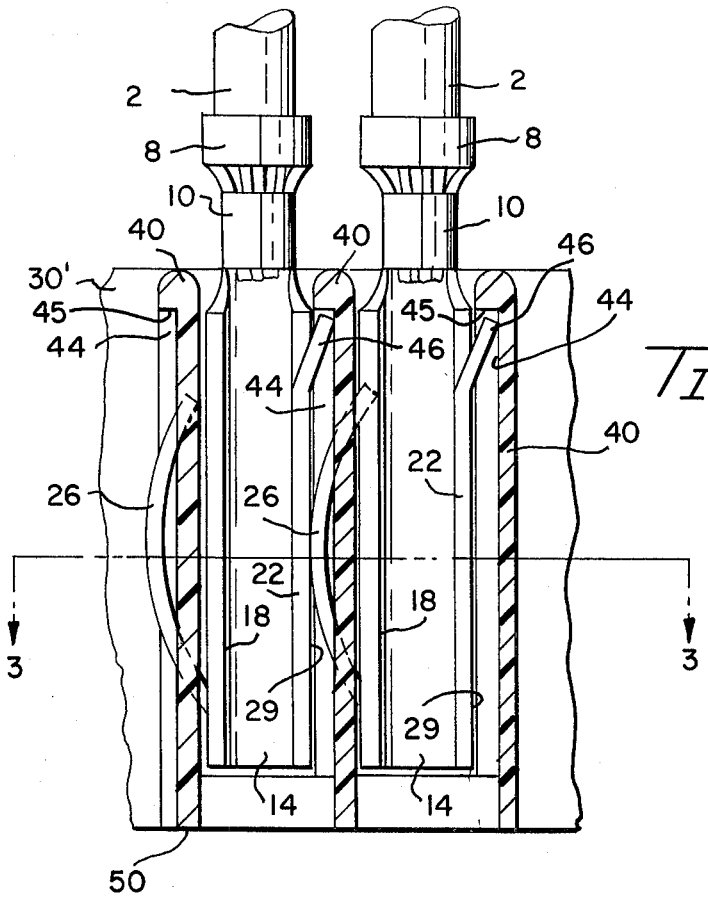
Figure 3:
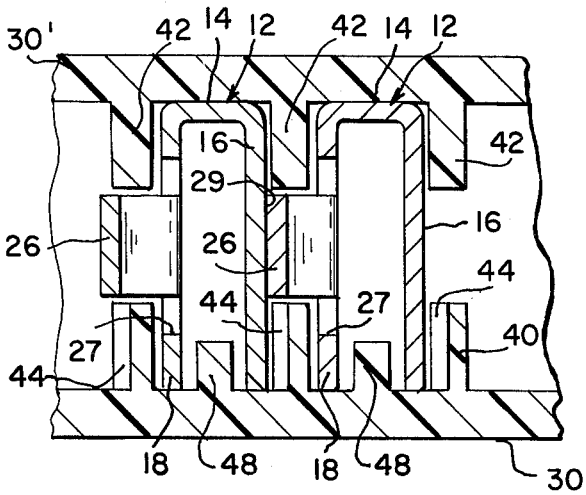

FIGS. 2 and 3 are views taken along the lines 2—2 and 3—3 of FIGS. 1 and 2 respectively.

The electrical commoning means or junction means in accordance with the invention serves to form an electrical junction among a plurality of wires 2. The commoning means comprises a housing 4 of suitable insulating material, such as glass-filled nylon, and terminals 6 which are crimped onto the ends of the wires. The individual terminals are of stamped and formed brass or other conductive metal and each terminal has an insulation crimp 8 and a wire barrel crimp 10, the insulation crimp serving to secure the terminal to the insulation of the wire and the wire barrel crimp 10 serving to establish the electrical connection between the terminal and the conducting core of the wire.

Each terminal has a flag-like contact portion 12 which extends from the end of the wire barrel crimp 10. The contact portion is generally U-shaped in cross section and has a web 14 and parallel spaced-apart sidewalls 16, 18 which extend from the side edge portions of the web. Each sidewall has a leading edge 20, a trailing edge 24, and an outer free edge 22 which extends between the leading and trailing edges.

A cantilever type contact spring 26 is struck from the sidewall 18 and is integral therewith adjacent to the leading edge 20. This spring extends arcuately outwardly away from the plane of the sidewall 18 and then back towards the plane of the sidewall. The length of the spring 26 relative to the length of the opening 27 in the sidewall should be such that the spring can be substantially flattened into the plane of the sidewall to permit removal of the terminal from the housing as will be discussed below.

The sidewall 22 has an outwardly facing surface 29 which serves as a contact surface for the spring 26 of an adjacent terminal when a plurality of terminals are positioned in the housing 4. Advantageously, a retaining ear 46 is formed in the sidewall 22 at the corner defined by the free edge 22 and the trailing edge 24 by shearing the sidewall for a short distance inwardly from the edge 24 adjacent to the corner. The ear is then bent outwardly as shown and cooperates with a shoulder in the housing to retain the terminal in the housing.

The housing 4 has parallel sidewalls 30, 30′ and end walls 32, 32′ from which suitable mounting ears 34 extend so that the housing can be mounted on a panel or the like. A separator wall 36 extends between the end walls 32, 32′ and midway between the two sidewalls 30, 30′.

As shown in FIG. 1, the upwardly facing side 31 of the housing constitutes a terminal-receiving face. A plurality of side-by-side terminal-receiving cells extend inwardly in the face 31 on each side of the separator wall 36. Each cell is separated from the next adjacent cell by a barrier wall means generally indicated at 38 and comprising two barrier wall sections 40, 42. The wall sections 40 extend from the central separator wall 36 and the wall sections 42 extend inwardly from the sidewalls 30, 30′. The space between the wall sections 40, 42 of each barrier wall 38 provides an opening which permits the contact spring 26 of the terminal inserted into each cell to project into the next adjacent cell. The width of the opening should, therefore, be sufficient to accommodate the spring as shown in the drawing.

The barrier wall sections 40 are undercut or relieved as shown at 44 immediately below their upper ends to provide a downwardly facing shoulder 45 which cooperates with the retaining ear 46 of an inserted terminal to prevent unintentional or accidental removal of the terminal from the cell into which it has been inserted.

Ribs 48 are provided in each cell between adjacent barrier wall sections 40. These ribs extend from the separator wall 36 and have a thickness which is substantially equal to the distance between the opposed surfaces of the sidewalls 16, 18 of the terminals. As will be explained below, these ribs ensure that the terminals will be inserted into the cells in the housing in their proper and intended orientations and the ribs additionally function to support the sidewalls and ensure that adequate contact pressure will be established at the electrical interfaces of adjacent terminals.

In use, an electrical junction among a plurality of wires 2 is formed by providing terminals on the ends of the wires and inserting the terminals into adjacent cells in the housing. It will be apparent from FIG. 1 that the terminals inserted on the left hand side of the separator wall 36 must be oriented such that the axes of the wires 2 are adjacent to the sidewall 30' while the terminals inserted into the cells on the right hand side of the separator wall 36 must be oriented such that the axes of the wires are adjacent to the sidewall 30 of the housing. The ribs 48 serve to prevent any other orientation of the terminals and the wires in the junction system will thus be neatly dressed and physically separated from each other to the maximum extend possible.

The mode of obtaining electrical contact between terminals inserted into adjacent cells is shown in FIG. 2. The contact spring 26 of the terminal on the right in FIG. 2 bears against the surface 29 of the terminal on the left of FIG. 2 and the spring is, therefore, flexed and establishes a low resistance electrical connection between the two terminals. As previously noted, the ribs 48 enhance the quality of the connection in that these ribs prevent the sidewalls of the terminals from being flexed towards each other by the effect of the springs 26. In other words, the ribs serve to brace the sidewalls against movement and contact pressure is thereby maintained at the electrical interface of adjacent terminals.

Any number of wires, up to the limit of the number of cells on each side of the wall 36, can be connected to a common junction by simply inserting the terminals into adjacent cells. The individual terminals can be removed by flexing the sidewalls 16, 18 of the terminal towards each other thereby to disengage the ear 28 of the terminal from the shoulder 46 of the barrier wall. The terminal can then be removed from the cell by simply pulling upwardly the wire to which the terminal is attached. The terminal removing operation can be carried out with a pair of long nosed pliers or a tweezer-like tool. In fact, the blade of a screwdriver can be used if other tools are not available.

More than one electrical junction can be provided on each side of the wall 36 by simply leaving one cell vacant between the two junctions. For example, three wires might be commonly connected at the right hand end of the housing and up to eight wires might be commonly connected by inserting the terminals into the remaining cells with one vacant cell separating the two junctions.

As shown in FIG. 2, the cells extend through the housing to the under side 50 thereof. This feature permits manufacture of the housing in a single action mold by an injection molding process. The core pins required for formation of the downwardly facing shoulder 45 would extend downwardly as viewed in the drawing and other core pins would extend downwardly from above. If desired, the lower ends of the cells can be provided with stops to prevent downward movement of the terminals beyond the positions shown.

An overall advantage of the commoning means shown is its relative simplicity as compared to the previous known junction systems. The housing 4 contains no metal parts and can be manufactured in a relatively simple mold by injection molding of a thermo-plastic material. The terminals 6 are of extremely simple construction and can also be manufactured at an extremely low cost. As noted above, no specialized tools are required to insert the terminals into the housing or to remove the terminals from the housing. Finally, and as also noted above, any desired number of separate electrical junctions, within the size limitations of the housing, can be provided in the housing by simply leaving at least one cell open or vacant between adjacent groups of terminals which form the separate junctions.

What is claimed is:

1. An electrical commoning means connecting a plurality of wires to each other at an electrical junction, said commoning means comprising:

a housing block of insulating material, said housing block being generally prismatic and having a terminal-receiving face, a plurality of side-by-side terminal-receiving cells extending inwardly from said face, adjacent cells in said housing block being separated from each other by spaced-apart parallel barrier walls, each of said barrier walls having an opening therein which extends from said face, each of said wires having a contact terminal thereon, each of said terminals having a crimp portion and a flag-like contact portion which has a U-shaped cross section comprising a web and spaced-apart parallel sidewalls extending from said web, said web comprising an axial extension of said crimp portion, a first one of said sidewalls having a contact spring struck therefrom and extending laterally from the plane of said first sidewall, a retention ear extending from the second one of said sidewalls, said retention ear comprising a tab member which extends towards said wire and divergently from the plane of said second sidewall, said cells being dimensioned to receive said contact portions of said terminals with said sidewalls disposed against the opposed surfaces of adjacent barrier walls and with said contact springs extending through said openings, polarizing means effective between said terminals and said cells effective to ensure insertion of said contact portions into said cells in a preferred orientation whereby said contact springs of all of said terminals engage said second sidewalls of adjacent terminals, and each of said cells having a shoulder therein adjacent to said terminal-receiving face for cooperation with said ear of an inserted terminal for retaining said terminal in said cell whereby, an electrical junction among a plurality of wires is formed by inserting said contact portions of said terminals on said wires into adjacent cells in said housing block.

2. A commoning means as set forth in claim 1, said polarizing means in each cell comprising a rib which is dimensioned to be received between said sidewalls of an inserted terminal.

3. A commoning means as set forth in claim 2, said terminal-receiving face being rectangular, a separator wall extending through said housing between the ends thereof, said separator wall dividing said housing into two sections, and a plurality of said cells in each of said sections.

* * * * *